US007173579B2

(12) United States Patent
Lee

(10) Patent No.: US 7,173,579 B2
(45) Date of Patent: Feb. 6, 2007

(54) APPARATUS FOR DRIVING 3-ELECTRODE PLASMA DISPLAY PANELS THAT PERFORMS SCANNING USING CAPACITOR

(75) Inventor: Joo-Yul Lee, Asan (KR)

(73) Assignee: Samsung SDI Co., Ltd., Suwon (KR)

( * ) Notice: Subject to any disclaimer, the term of this patent is extended or adjusted under 35 U.S.C. 154(b) by 286 days.

(21) Appl. No.: 10/384,728

(22) Filed: Mar. 11, 2003

(65) Prior Publication Data

US 2003/0184501 A1 Oct. 2, 2003

(30) Foreign Application Priority Data

Mar. 28, 2002 (KR) ..... 2002-17102

(51) Int. Cl.
*G09G 3/28* (2006.01)
*G09G 5/00* (2006.01)

(52) U.S. Cl. ..... 345/60; 345/204

(58) Field of Classification Search ..... 345/41–42, 345/60–62, 67, 69–70
See application file for complete search history.

(56) References Cited

U.S. PATENT DOCUMENTS 5,081,400 A * 1/1992 Weber et al. ..... 315/169.4
6,111,556 A * 8/2000 Moon ..... 345/60
6,686,912 B1 * 2/2004 Kishi et al. ..... 345/211

FOREIGN PATENT DOCUMENTS

KR P2003-0052445 6/2003

* cited by examiner

*Primary Examiner*—Sumati Lefkowitz
*Assistant Examiner*—Alexander S. Beck
(74) *Attorney, Agent, or Firm*—HC Park & Associates, PLC

(57) ABSTRACT

The Y-driver of a 3-electrode plasma display panel driving apparatus includes a switching output circuit and a capacitor. In the switching output circuit, upper and lower transistors are disposed in such a way that the common output line of an upper transistor and a lower transistor is connected to a corresponding Y electrode line. The capacitor is connected between the common power line of all of the upper transistors in the switching output circuit and the common power line of all of the lower transistors in the switching output circuit. A voltage due to charging of the capacitor is applied to the common power line of all of the upper transistors in the switching output circuit.

19 Claims, 11 Drawing Sheets

APPARATUS FOR DRIVING 3-ELECTRODE PLASMA DISPLAY PANELS THAT PERFORMS SCANNING USING CAPACITOR

BACKGROUND OF THE INVENTION

1. Field of the Invention

The present invention relates to a driving apparatus for 3-electrode plasma display panels, and more particularly, to a driving apparatus for a 3-electrode plasma display panel having a 3-electrode surface-discharge structure, the structure in which X electrode line and Y electrode line are alternately disposed parallel to one another so as to create XY electrode line pairs, address electrode lines are disposed so as to intersect the XY electrode line pairs, and display cells are defined at the intersections.

2. Background Description

FIG. 1 shows the structure of a general 3-electrode surface-discharge type plasma display panel 1, while FIG. 2 shows a display cell on the panel of FIG. 1. Referring to FIGS. 1 and 2, address electrode lines $A_{R1}$ through $A_{Rm}$ (represented by $A_{Rm}$), $A_{G1}$ through $A_{Gm}$ (represented by $A_{Gm}$), and $A_{B1}$ through $A_{Bm}$ (represented by $A_{Bm}$), front dielectric layer 11 and rear dielectric layer 15, Y electrode lines $Y_1$ through and $Y_n$, X electrode lines $X_1$ through and $X_n$, a fluorescent layer 16, barrier ribs 17, and a magnesium monoxide (MgO) layer 12 as a protective membrane are provided between front glass substrate 10 and rear glass substrate 13 of the general surface-discharge type plasma display panel 1.

The address electrode lines $A_{R1}$, $A_{G1}$ through $A_{Gm}$, and $A_{Bm}$ are disposed on the front surface of the rear glass substrate 13 in a predetermined pattern, and entirely coated with the rear dielectric layer 15. The barrier ribs 17 are formed parallel to the address electrode lines $A_{R1}$, $A_{G1}$ through $A_{Gm}$, and $A_{Bm}$ on the front surface of the rear dielectric layer 15. The barrier ribs 17 define a discharge area on each display cell and prevent optical cross talk between display cells. The fluorescent layer 16 is formed between the barrier ribs 17.

The X electrode lines $X_1$ through $X_n$ and the Y electrode lines $Y_1$, through $Y_n$ are formed on the rear surface of the front glass substrate 10 in a predetermined pattern so that they intersect the address electrode lines $A_{R1}$, $A_{G1}$ through $A_{Gm}$, and $A_{Bm}$ at right angles. Each intersection corresponds to a display cell. To form each of the X electrode lines $X_1$ through $X_n$, a transparent conductive electrode line $X_{na}$ of FIG. 2, such as an indium tin oxide (ITO), is combined with a metallic electrode line $X_{nb}$ of FIG. 2 to increase conductivity. Likewise, to form each of the Y electrode lines $Y_1$ through $Y_n$, a transparent conductive electrode line $Y_{na}$ of FIG. 2, such as an indium tin oxide (ITO), is combined with a metallic electrode line $Y_{nb}$ of FIG. 2 to increase conductivity. The X electrode lines $X_1$ through and $X_n$ and the Y electrode lines $Y_1$ through and $Y_n$ are entirely coated with the front dielectric layer 11. The magnesium monoxide (MgO) layer 12 for protecting the panel 1 from a strong electric field is formed on the entire rear surface of the front dielectric layer 11. Plasma forming gas fills a discharge space 14.

FIG. 3 shows a conventional address-display separation driving method of the Y electrode lines of the plasma display panel of FIG. 1. Referring to FIG. 3, a unit frame is divided into 8 sub-fields SF1 through SF8 in order to achieve time-division gray level display. Each of the sub-fields SF1 through SF8 is respectively divided into an address period A1 through A8 and a display sustain period S1 through S8.

During each of the address periods A1 through A8, while a display data signal is applied to the address electrode lines $A_{R1}$, $A_{G1}$ through $A_{Gm}$, and $A_{Bm}$ of FIG. 1, appropriate scanning pulses are sequentially applied to the Y electrode lines $Y_1$ through $Y_n$. During the application of the scanning pulses, if a high-level display data signal is applied to an address electrode line, wall charges are formed on a discharge cell corresponding to the address electrode line, but the other discharge cells do not gain wall charges.

In each of the display sustain periods S1 through S8, a display discharge pulse is applied to all of the X electrode lines, $X_1$ through $X_n$, and all of the Y electrode lines, $Y_1$ through $Y_n$, in such a way that the display discharge pulse alternates between them. As a consequence, a display discharge occurs on discharge cells having wall charges formed in each of the address periods A1 through A8. As a result, the luminance of a plasma display panel is proportional to the length of the display sustain periods S1 through S8 for a unit frame. In the plasma display panel of FIG. 3, the length of the display sustaining periods S1 through S8 for a unit frame is 255T (T denotes a unit of time). Hence, a unit frame can express 256 gray levels including a zero gray level, where no display discharge occurs.

A time 1T, corresponding to $2^0$, is set for the display sustain period S1 of the first sub-field SF1. A time 2T, corresponding to $2^1$, is set for the display sustain period S1 of the second sub-field SF2. A time 4T, corresponding to $2^2$, is set for the display sustain period S3 of the third sub-field SF3. A time 8T, corresponding to $2^3$, is set for the display sustain period S4 of the fourth sub-field SF4. A time 16T, corresponding to $2^4$, is set for the display sustain period S5 of the fifth sub-field SF5. A time 32T, corresponding to $2^5$, is set for the display sustain period S6 of the sixth sub-field S6. A time 64T, corresponding to $2^6$, is set for the display sustain period S7 of the seventh sub-field SF7. A time 128T, corresponding to $2^7$, is set for the display sustain period S8 of the eighth sub-field SF8.

Accordingly, it can be seen from FIG. 3 that, when sub-fields to be displayed are appropriately selected from the 8 sub-fields, any of the selected sub-fields can display 256 gray levels including a zero gray scale, in which display discharge does not occur.

In the above-described address-display separation driving method, since the subfields SF1 through SF8 are temporally separated in a unit frame, the address period and the display sustain period are temporally separated in each of the subfields SF1 through SF8. To be more specific, in an address period, each pair of X and Y electrodes is addressed, and waits for the next operation until the other pairs of X and Y electrodes are all addressed. Consequently, the time for the address period in each subfield is lengthened, while the display sustain period is relatively shortened. This lowers the luminance of light emitted from a plasma display panel. In order to solve this problem, an address-while-display driving method as shown in FIG. 4 has been developed.

FIG. 4 shows a conventional address-while-display driving method applied to the Y electrode lines of the plasma display panel of FIG. 1. Referring to FIG. 4, a unit frame is divided into 8 subfields $SF_1$ through $SF_8$ in order to achieve time-division gray-scale display. The subfields overlap one another with respect to the Y electrode lines $Y_1$ through $Y_n$ and constitute a unit frame. Hence, all of the subfields $SF_1$ through $SF_8$ exist at every time point and an addressing time slot is set between display discharge pulses in order to perform each addressing.

A reset step, an address step, and a display sustaining step are performed on each of the subfields, and the time allocated to each of the subfields is determined based on a display discharging time corresponding to a gray scale. If 8-bit image data display 256 gray scales per unit frame and the unit frame (generally, 1/60 sec) is divided into 255 unit periods, the first subfield $SF_1$ driven based on the least significant bit (LSB) image data has one ($2^0$) unit period, the second subfield $SF_2$ has 2 ($2^1$) unit periods, the third subfield $SF_3$ has 4 ($2^2$) unit periods, the fourth subfield $SF_4$ has 8 ($2^3$) unit periods, the fifth subfield $SF_5$ has 16 ($2^4$) unit periods, the sixth subfield $SF_6$ has 32 ($2^5$) unit periods, the seventh subfield $SF_7$ has 64 ($2^6$) unit periods, and the eighth subfield $SF_8$, driven based on the most significant bit (MSB) of the image data, has 128 ($2^7$) unit periods. That is, since the sum of the unit periods allocated to the subfields is 255 unit periods, 255 gray scales can be displayed. If no discharge on any subfield is included, 256 gray scales can be displayed.

FIG. 5 shows a general driving apparatus for the plasma display panel of FIG. 1. Referring to FIG. 5, the general driving apparatus for the plasma display panel 1 of FIG. 1 includes an image processor 66, a logic controller 62, an address driver 63, an X-driver 64, and a Y-driver 65. The image processor 66 converts an external analog image signal into a digital signal and generates an internal image signal, for example, 8-bit red (R) image data, 8-bit green (G) image data, 8-bit blue (B) image data, a clock signal, and vertical and horizontal synchronous signals. The logic controller 62 generates driving control signals $S_A$, $S_Y$, and $S_X$ according to the internal image signal received from the image processor 66. The address driver 63 processes the address signal $S_A$ out of the driving control signals $S_A$, $S_Y$, and $S_X$ to obtain a display data signal, and applies the display data signal to address electrode lines. The X-driver 64 processes the X driving control signal $S_X$ out of the driving control signals $S_A$, $S_Y$, and $S_X$ and applies the resultant signal to X electrode lines. The Y-driver 65 processes the Y driving control signal $S_Y$ out of the driving control signals $S_A$, $S_Y$, and $S_X$ and applies the resultant signal to Y electrode lines.

FIG. 6 shows driving signals applied to a unit subfield on the panel of FIG. 1 by the address-display separation driving method of FIG. 3. Referring to FIG. 6, reference character $S_{AR1 \ldots ABm}$ denotes a driving signal applied to the address electrode lines $A_{R1}$ through $A_{Rm}$, $A_{G1}$ through $A_{Gm}$, and $A_{B1}$ through $A_{Bm}$ of FIG. 1. Reference character $S_{X1 \ldots Xn}$ denotes a driving signal applied to the X electrode lines $X_1$ through $X_n$ of FIG. 1, and reference characters $S_{Y1}$ through and $S_{Yn}$ denote a driving signal applied to the Y electrode lines $Y_1$ through $Y_n$ of FIG. 1, respectively. FIG. 7 shows wall charges distributed on a display cell at the point in time immediately after a gradual rising voltage is applied to the Y electrode lines $Y_1$ through $Y_n$ during a reset period PR of FIG. 6. FIG. 8 shows wall charges distributed on a display cell when the reset period PR of FIG. 6 terminates. Referring to FIG. 6, during the reset period PR of a unit subfield SF, first, the driving voltage $S_{X1 \ldots Xn}$ continuously increases from a ground voltage $V_G$ to a second voltage $V_S$, for example, 155 V. At this time, the ground voltage $V_G$ is applied to the Y electrode lines $Y_1$, through $Y_n$ and the address electrode lines $A_{R1}$, $A_{G1}$ through $A_{Gm}$, and $A_{Bm}$. Accordingly, while a weak discharge occurs between the X electrode lines $X_1$ through $X_n$ and the Y electrode lines $Y_1$ through $Y_n$ and between the X electrode lines $X_1$ through $X_n$ and the address electrode lines $A_{R1}$ to $A_{Bm}$, negative wall charges are formed around the X electrode lines $X_1$ through $X_n$.

Next, the driving voltages $S_{Y1}$ through $S_{Yn}$ continuously increase from the second voltage $V_s$, for example, 155 V, to the highest voltage ($V_{SET}+V_S$), for example, 355 V. The voltage ($V_{SET}+V_S$) is obtained by adding a third voltage $V_{SET}$ to the second voltage $V_S$. While the voltages $S_{Y1}$ through $S_{Yn}$ increase from the second voltage to the highest voltage, the ground voltage $V_G$ is applied to the X electrode lines $X_1$ through $X_n$ and the address electrode lines $A_{R1}$ to $A_{Bm}$. Accordingly, a weak discharge occurs between the X electrode lines and the Y electrode lines, and a weaker discharge occurs between the Y electrode lines and the address electrode lines. The discharge between the X electrode lines and the Y electrode lines is stronger than the discharge between the Y electrode lines and the address electrode lines, because negative wall charges have been formed around the X electrode lines. Consequently, many negative wall charges are formed around the Y electrode lines, positive wall charges are formed around the X electrode lines, and a few positive wall charges are formed around the address electrode lines, as shown in FIG. 7.

After the voltage increases from $V_S$ to ($V_{SET}+V_S$), while the driving voltage $S_{X1 \ldots Xn}$ is maintained at the second voltage $V_S$, the driving voltages $S_{Y1}$, through $S_{Yn}$ continuously decreases from the second voltage $V_S$ to the ground voltage $V_G$. At this time, the ground voltage $V_G$ is applied to the address electrode lines $A_{R1}$, $A_{G1}$ through $A_{Gm}$, and $A_{Bm}$. Accordingly, due to a weak discharge between the X electrode lines and the Y electrode lines, some of the negative wall charges around the Y electrode lines move toward the X electrode lines, as shown in FIG. 8. Also, due to the ground voltage $V_G$ being applied to the address electrode lines, the number of positive wall charges around the address electrode lines slightly increases.

Accordingly, during the subsequent address period PA, smooth addressing can be performed as a display data signal is applied to the address electrode lines, and the Y electrode lines biased to a fourth voltage $V_{SCAN}$, which is lower than the second voltage $V_S$, are sequentially subject to a scanning signal with the ground voltage $V_G$. If a display cell is selected, a display data signal with positive address voltage $V_A$ is applied to the address electrode lines. Otherwise, a display data signal with the ground voltage $V_G$ is applied to the address electrode lines. Accordingly, when a display data signal with the positive address voltage $V_A$ is applied while a scanning pulse with the ground voltage $V_G$ is applied, wall charges are formed on a corresponding display cell due to address discharge, but no wall charges are formed on the other display cells. At this time, in order to achieve more accurate and efficient address discharge, the second voltage $V_S$ is applied to the X electrode lines.

Subsequently, during the display sustaining period PS, a display sustaining pulse with the second voltage $V_S$ is applied to each of the X electrode lines and each of the Y electrode lines in such a way that the display sustaining pulse alternates between them. Thus, a discharge for sustaining the display occurs on display cells having wall charges formed during the address period PA.

FIG. 9 shows a structure of a conventional Y-driver of a driving apparatus for applying the driving signals of FIG. 6. Referring to FIGS. 6 and 9, the conventional Y-driver includes a reset/sustaining circuit RSC, a scan driving circuit AC, and a switching output circuit SIC. The reset/sustaining circuit RSC generates driving signals to be applied to the Y electrode lines during the reset period PR and the display sustaining period PS. The scan driving circuit AC generates driving signals to be applied to the Y electrode lines during the addressing period PA. In the switching output circuit SIC, upper transistors YU1 through YUn and lower transistors YL1 through YLn are disposed to create upper transistor/lower transistor pairs, and the common output lines of the upper transistor/lower transistor pairs are connected to the Y electrode lines $Y_1$ through $Y_n$ of the 3-electrode plasma display panel 1. The operation of the Y-driver of FIG. 9 will now be described with reference to FIGS. 6 and 9.

During the reset period PR and the display sustaining period PS, the driving signals $O_{RS}$ from the reset/sustaining circuit RSC are applied to the Y electrode lines of the 3-electrode plasma display panel 1 via a point A in the scan driving circuit AC and the lower transistors YL1 through YLn in the switching output circuit SIC. At this time, all large power transistors $S_{SC1}$, $S_{SC2}$, $S_{SP}$, and $S_{SCL}$ in the scan driving circuit AC are turned off. The driving signals $O_{RS}$ from the reset/sustaining circuit RSC are applied to the Y electrode lines of the 3-electrode plasma display panel 1 via the point A and the third large power transistor $S_{SP}$ in the scan driving circuit AC and the upper transistors YU1 through YUn in the switching output circuit SIC. At this time, the large power transistors $S_{SC1}$, $S_{SC2}$, and $S_{SCL}$ excluding the third large power transistor $S_{SP}$ in the scan driving circuit AC are turned off.

During the address period PA, the large power transistors $S_{SC1}$, $S_{SC2}$, and $S_{SCL}$ excluding the third large power transistor $S_{SP}$ in the scan driving circuit AC are turned on. A scan bias voltage $V_{SCAN}$ is applied via the first large power transistor $S_{SC1}$ and second large power transistors $S_{SC2}$ to the upper transistors YU1 through YUn of the switching output circuit SIC. The ground voltage $V_G$ (FIG. 6) is applied to the lower transistors YL1 through YLn of the switching output circuit SIC via the fourth large power transistor $S_{SCL}$. In this case, the lower transistor connected to a Y electrode line to be scanned is turned on, while the upper transistor connected to the Y electrode line to be scanned is turned off. The lower transistors connected to the other Y electrode lines not to be scanned are turned off, while the upper transistors connected to the Y electrode lines not to be scanned are turned on. The scan ground voltage $V_G$ is then applied to the Y electrode line to be scanned, and the scan bias voltage $V_{SCAN}$ is applied to the other Y electrode lines not to be scanned.

During the addressing period PA, when the scan ground voltage $V_G$ is applied to the Y electrode line to be scanned, current from the display cells (electrical capacitors) connected to the Y electrode line to be scanned passes through a lower transistor in the switching output circuit SIC and the fourth large power transistor $S_{SCL}$ in the scan driving circuit AC and then flows to a ground terminal.

During the addressing period PA, when a display data signal is applied to the address electrode lines, discharge current from the address electrode lines to which a selection voltage $V_A$ has been applied flows to an Y electrode line that is being scanned. At this time, current sequentially passes through the other Y electrode lines not being scanned, the upper transistors of the switching output circuit SIC, and the first and second large power transistors $S_{SC1}$ and $S_{SC2}$ in the scan driving circuit AC and then flows to the terminal of the scan bias voltage $V_{SCAN}$.

During the addressing period PA, at the point in time when the application of the display data signal to the address electrode lines $A_{R1}$, $A_{G1}$ through $A_{Gm}$, and $A_{Bm}$ terminates, current from the terminal of the scan bias voltage $V_{SCAN}$ passes through the first and second large power transistors $S_{SC1}$ and $S_{SC2}$ in the scan driving circuit AC, the upper transistors of the switching output circuit SIC, and the Y electrode lines and then flows to the address electrodes $A_{R1}$, $A_{G1}$ through $A_{Gm}$, and $A_{Bm}$.

During the addressing period PA, at the point in time when the application of the scan ground voltage $V_{SCAN}$ to the one Y electrode line to be scanned terminates, current from the terminal of the scan bias voltage $V_{SCAN}$ passes through the first and second large power transistors $S_{SC1}$ and $S_{SC2}$ in the scan driving circuit AC, the upper transistors of the switching output circuit SIC, and the Y electrode lines and then flows to the display cells (electrical capacitors).

Accordingly, it can be seen that large power transistors for switching must be connected between the common line of the upper transistors in the SIC and the terminal of the scan bias voltage $V_{SCAN}$. When only one large power transistor $S_{SC1}$ or $S_{SC2}$ is connected, the following two problems are generated.

Firstly, if only the second large power transistor $S_{SC2}$ is connected, the driving signals $O_{RS}$ from the reset/sustaining circuit RSC are applied to the terminal of the scan bias voltage $V_{SCAN}$ via the internal diode of the second large power transistor $S_{SC2}$ during the reset period PR and the display sustaining period PS, such that current flows. As a result, driving during the reset period PR and the display sustaining period PS is unstable, and power consumption increases.

Secondly, if only the first large power transistor $S_{SC1}$ is connected, an unexpected over-shoot pulse from the reset/sustaining circuit RSC can be applied to the upper transistors YU1 through YUn of the switching output circuit SIC through the internal diode of the first large power transistor $S_{SC1}$. As a result, driving during each of the periods may be unstable. For these reasons, two large power transistors $S_{SC1}$ and $S_{SC2}$ are needed.

If the upper and lower common lines are simply disconnected because of absence of the third large power transistor $S_{SP}$, the driving signals $O_{RS}$ from the reset/sustaining circuit RSC are applied to all of the Y electrode lines $Y_1$ through $Y_n$ through the lower transistors YL1 through YLn of the SIC during the reset period PR and the display sustaining period PS, and also applied to the first large power transistor $S_{SC1}$ through the internal diodes of the upper transistors and the second large power transistor $S_{SC2}$ in the scan driving circuit AC. As a result, the performance of the first large power transistor $S_{SC1}$ can be degraded, and the durability shortened. However, if the third large power transistor $S_{SP}$ exists, a predetermined voltage drops to the third large power transistor $S_{SP}$. Thus, a voltage applied to the first large power transistor $S_{SC1}$ can be lowered.

As described above, a conventional apparatus for driving a 3-electrode plasma display panel has a deficiency in that the scan driving circuit AC of a Y driver requires four expensive large power transistors $S_{SC1}$, $S_{SC2}$, $S_{SP}$, and $S_{SCL}$.

SUMMARY OF THE INVENTION

To solve the above and other problems, it is an object of the present invention to provide a driving apparatus for a 3-electrode plasma display panel, by which the number of costly large power transistors required by the scan driving circuit of a Y driver is minimized.

To achieve the above and other objects, a 3-electrode plasma display panel driving apparatus of the present invention includes an image processor for converting an external analog image signal into a digital signal to obtain an internal image signal, a controller for generating driving control signals according to the internal image signal of the image processor, an address driver for processing an address signal from the controller to obtain a display data signal and applying the display data signal to address electrode lines, an X-driver for processing an X driving control signal from the controller and applying the processed X driving control signal to X electrode lines, and a Y-driver for processing a Y driving control signal from the controller and applying the processed Y driving control signal to Y electrode lines.

The Y-driver includes a switching output circuit and a capacitor. In the switching output circuit, upper transistor and lower transistor are disposed in such a way that the common output line of an upper transistor and a lower transistor is connected to a corresponding Y electrode line. The capacitor is connected between the common power line of all the upper transistors in the switching output circuit and the common power line of all the lower transistors in the switching output circuit. Here, a voltage due to charging of the capacitor is applied to the common power line of all the upper transistors in the switching output circuit.

According to the 3-electrode plasma display panel driving apparatus, since a constant voltage can be maintained in the capacitor, two large power transistors as required in a conventional Y-driver do not need to be connected between the common power line of the upper transistors of the switching output circuit and a power terminal.

BRIEF DESCRIPTION OF THE DRAWINGS

The above and other objects and advantages of the present invention will become more apparent by describing in detail preferred embodiments thereof with reference to the attached drawings.

DETAILED DESCRIPTION OF THE INVENTION

Figure 1:
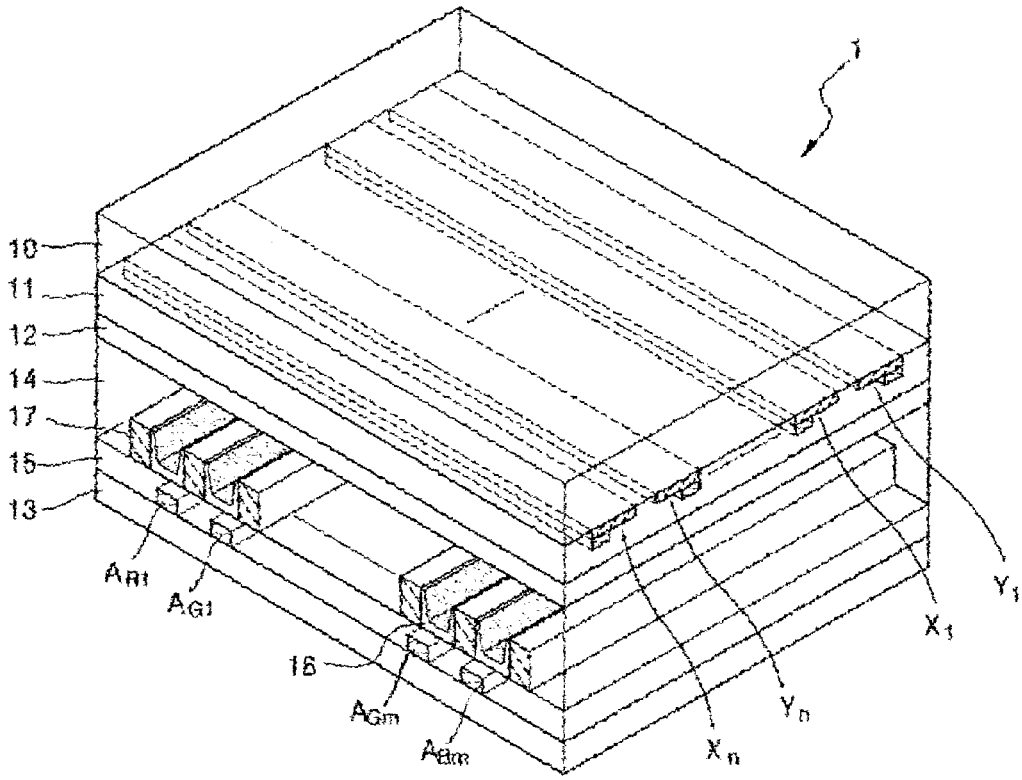
FIG. 1 (RELATED ART)
FIG. 1 is an internal perspective view of the structure of a general 3-electrode surface-discharge type plasma display panel.
Figure 2:
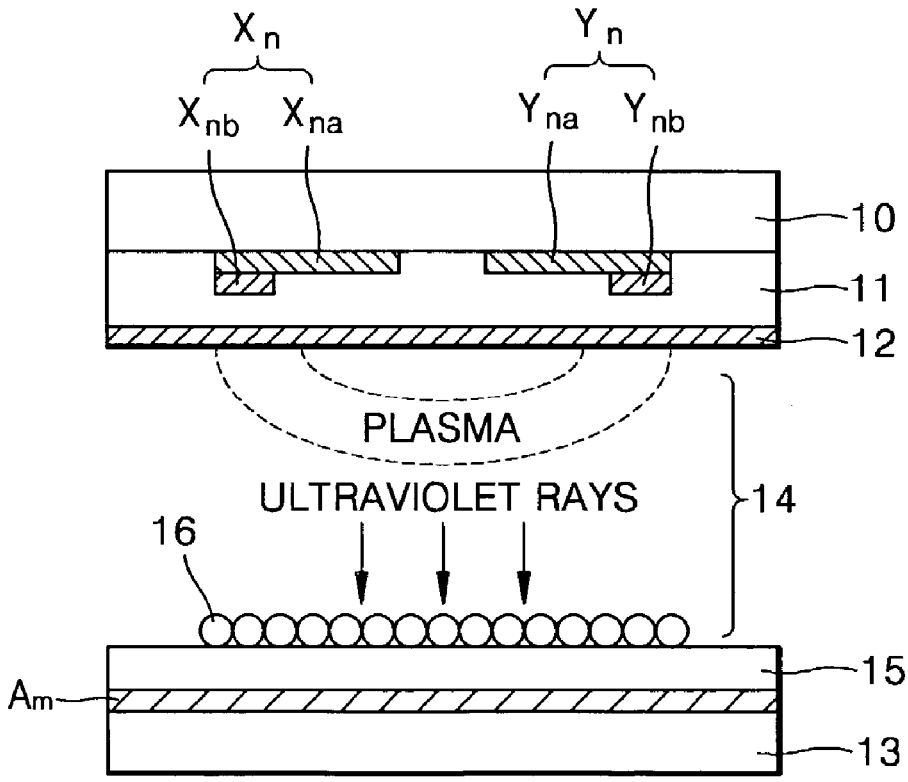
FIG. 2 (RELATED ART)
FIG. 2 is a cross-section of a display cell of the panel of FIG. 1.
Figure 3:
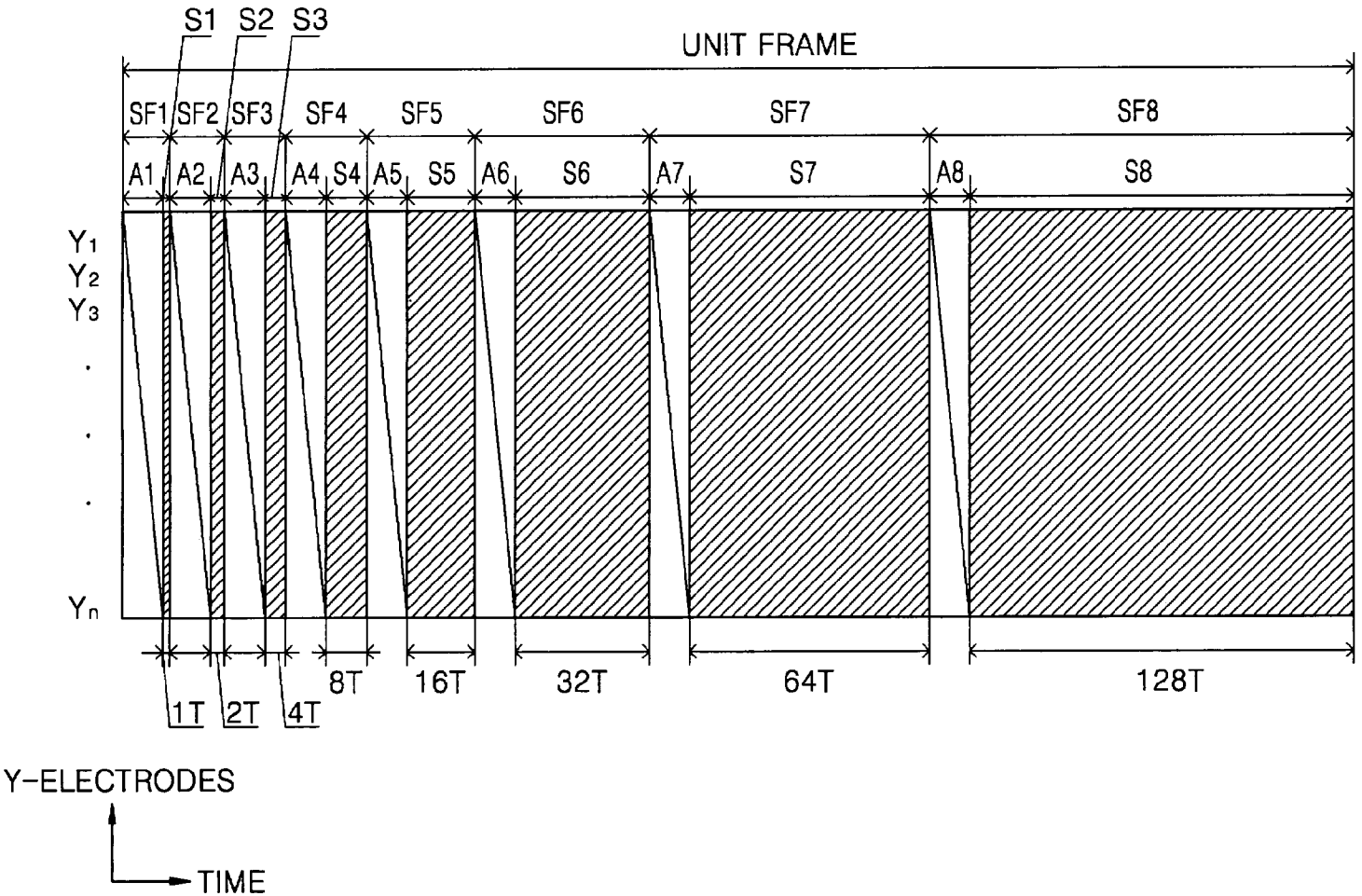
FIG. 3 (RELATED ART)
FIG. 3 is a timing diagram showing a conventional address-display separation driving method of the Y electrode lines of the plasma display panel of FIG. 1.
Figure 4:
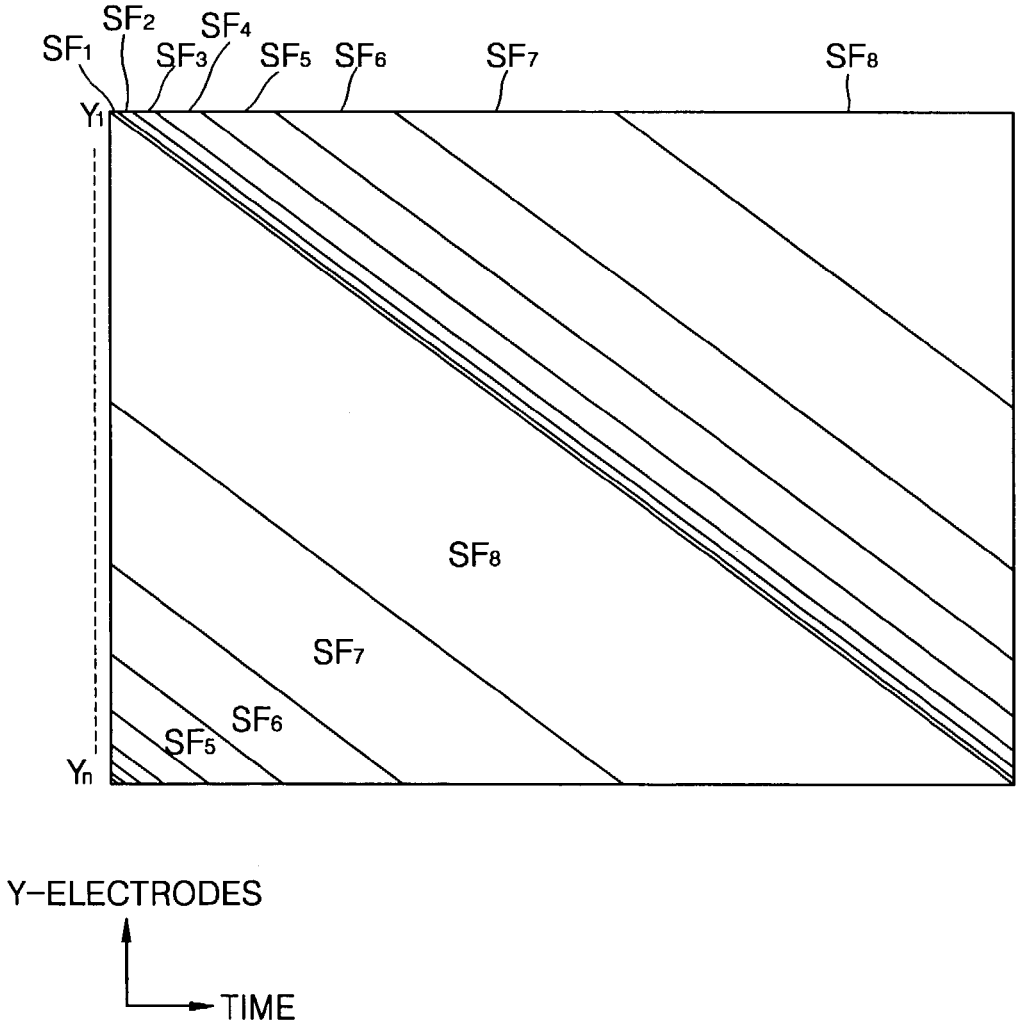
FIG. 4 (RELATED ART)
FIG. 4 is a timing diagram showing a conventional address-while-display driving method of the Y electrode lines of the plasma display panel of FIG. 1.
Figure 5:
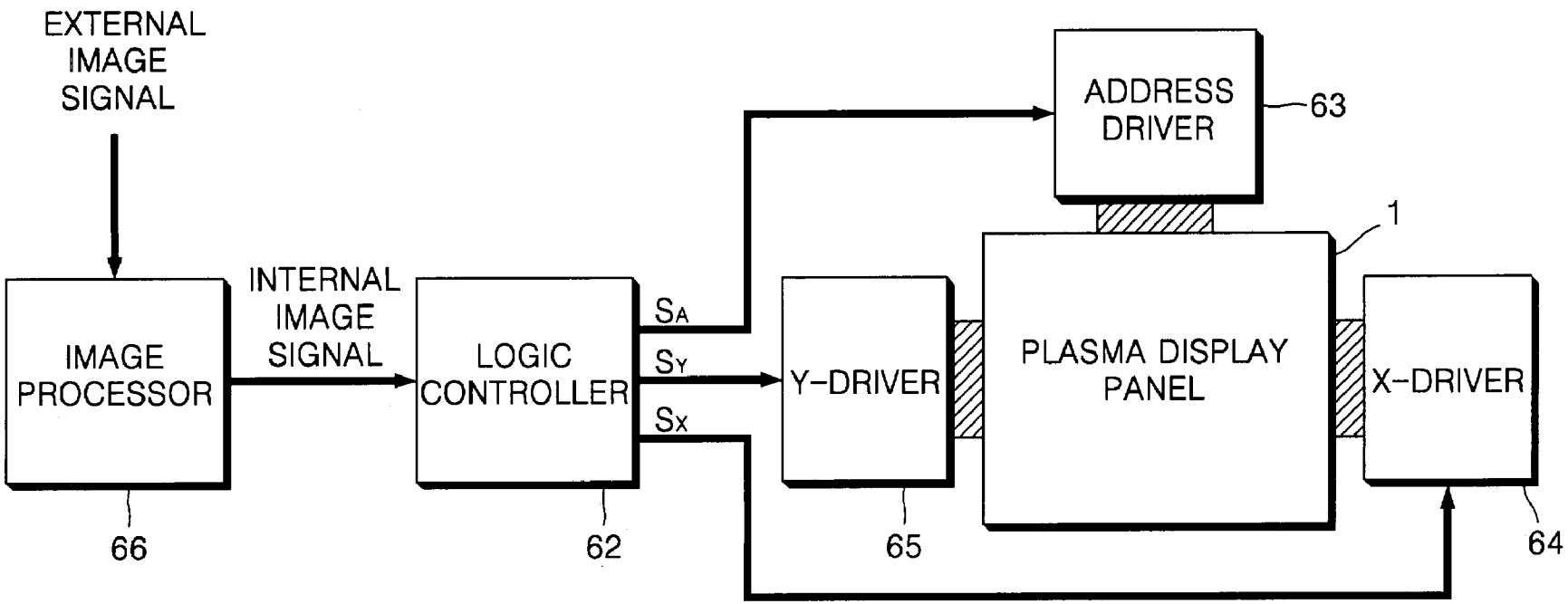
FIG. 5 (RELATED ART)
FIG. 5 is a block diagram of a general driving apparatus for the plasma display panel of FIG. 1.
Figure 6:
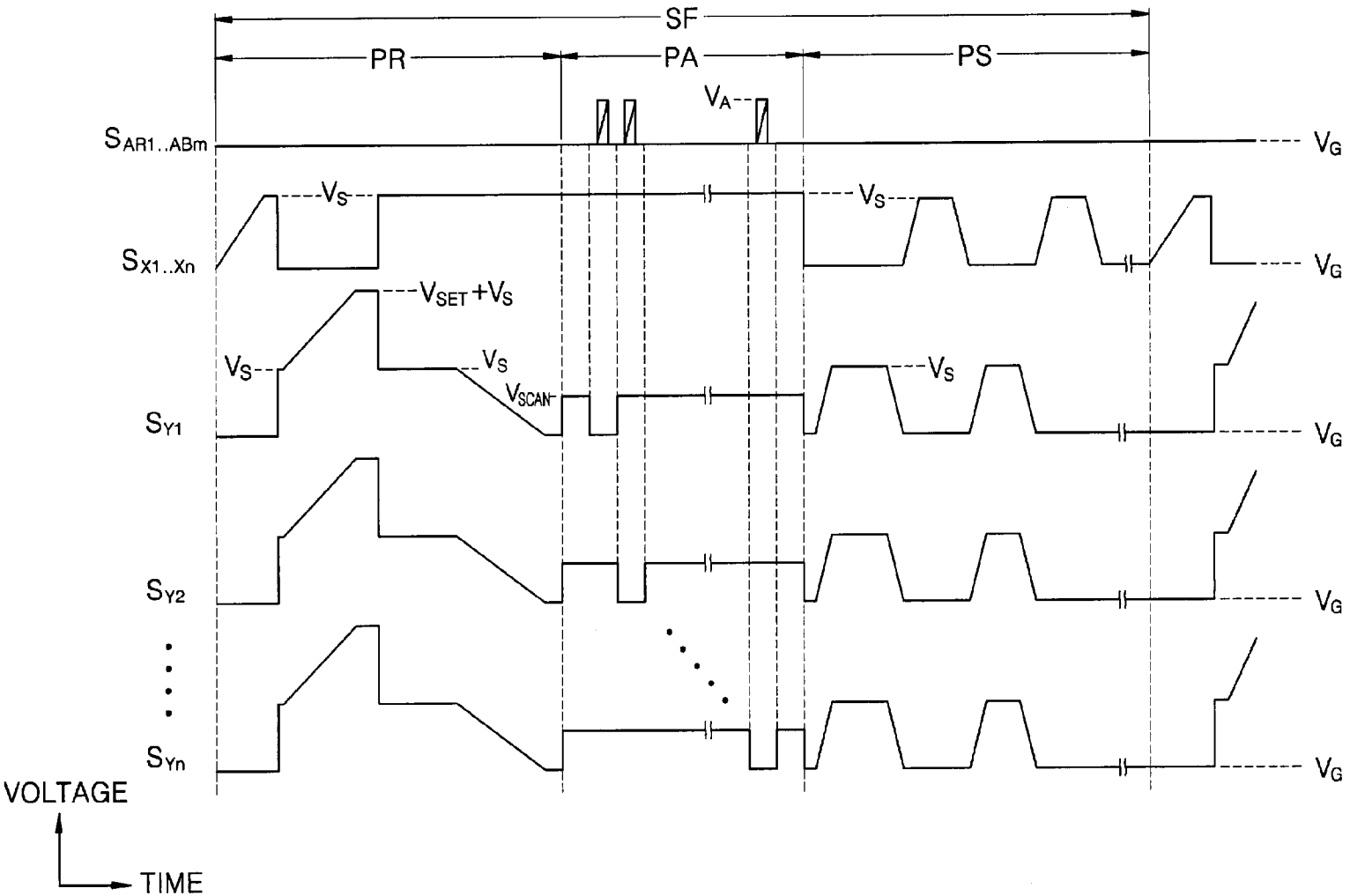
FIG. 6 (RELATED ART)
FIG. 6 is a timing diagram showing driving signals applied to a unit subfield on the panel of FIG. 1 by the address-display separation driving method of FIG. 3.
Figure 7:
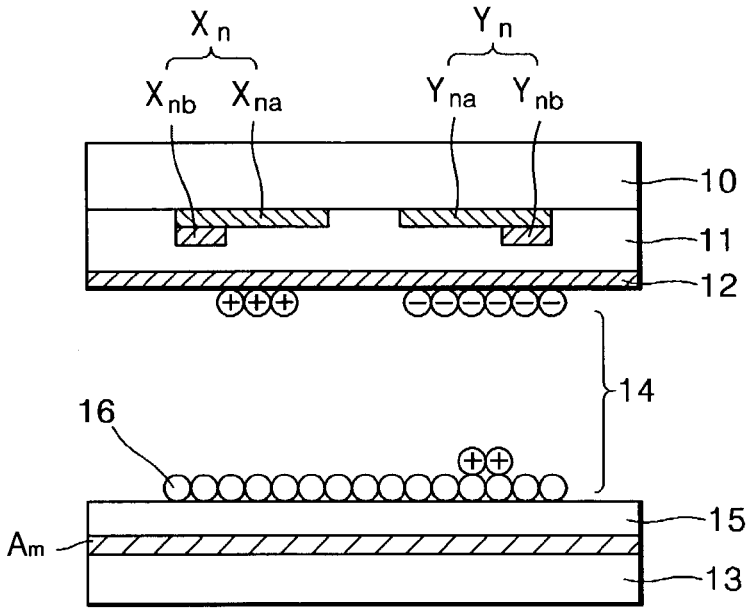
FIG. 7 (RELATED ART)
FIG. 7 is a cross-sectional view showing wall charges distributed on a display cell at an instant of the point in time immediately after a gradual rising voltage is applied to the Y electrode lines during the reset period of FIG. 6.
Figure 8:
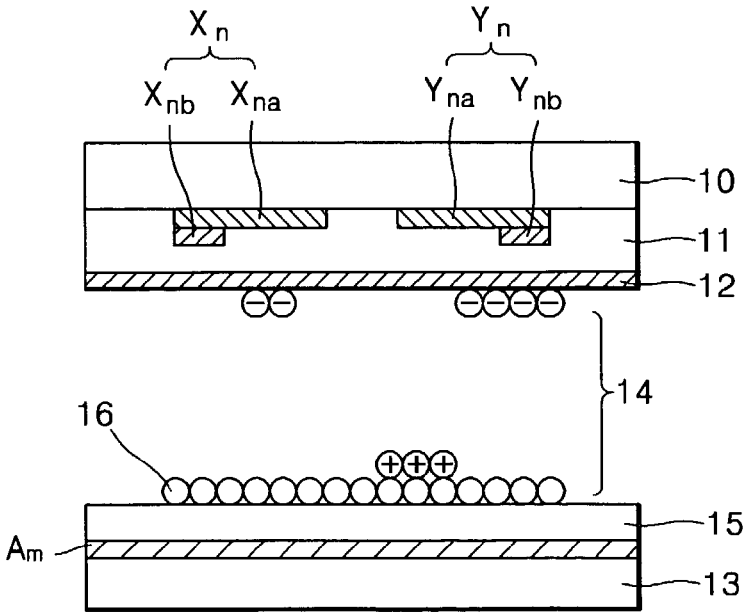
FIG. 8 (RELATED ART)
FIG. 8 is a cross-sectional view showing wall charges distributed on a display cell at the point in time when the reset period of FIG. 6 is terminated.
Figure 10:
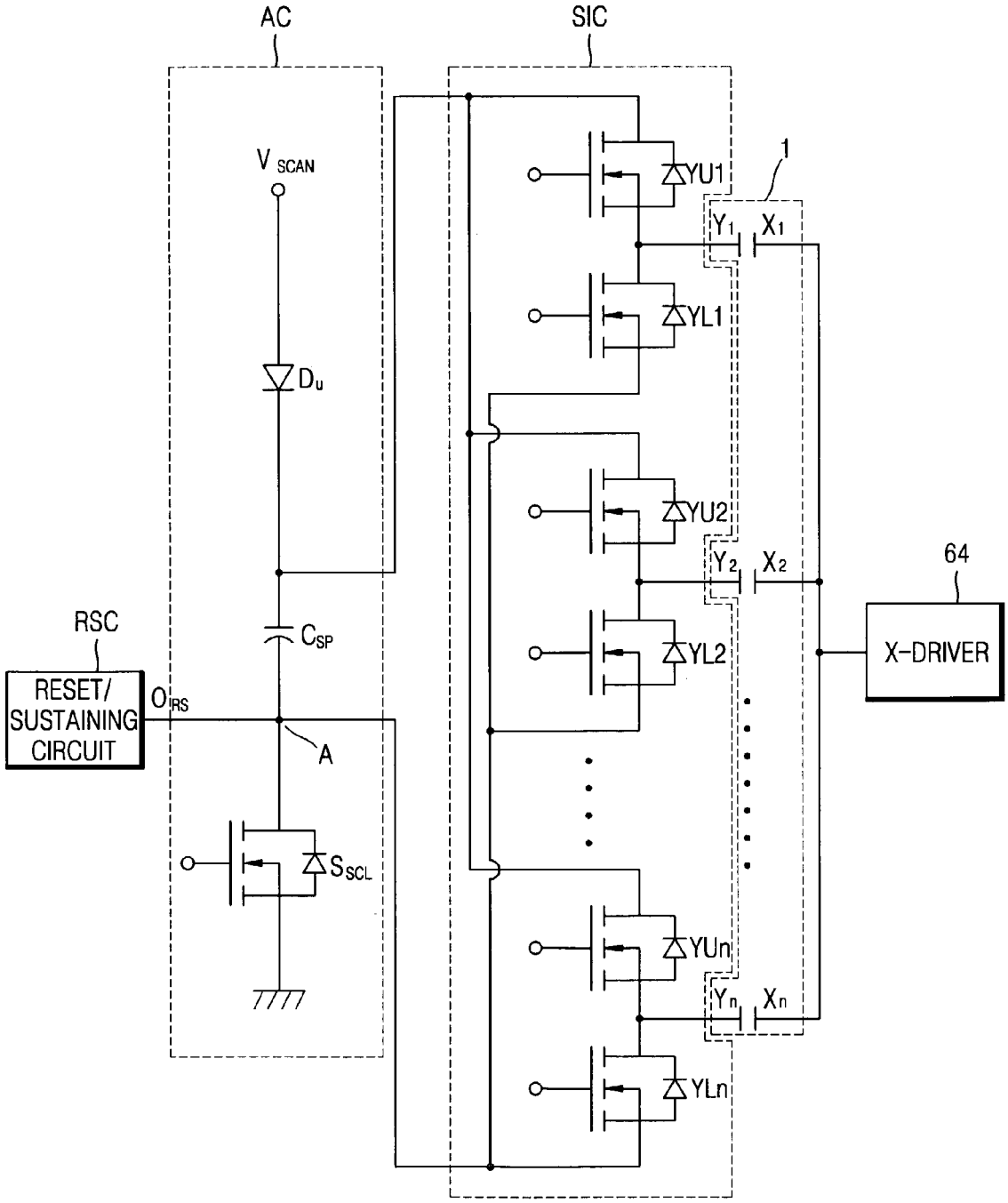
FIG. 10 is a circuit diagram showing a scan driving circuit according to an embodiment of the present invention and a switching output circuit that are included in the Y-driver of a driving apparatus for applying the driving signals of FIG. 6.

FIG. 10 shows a scan driving circuit (AC) according to an embodiment of the present invention and a switching output circuit (SIC) that are included in the Y-driver 65 of FIG. 5 in the driving apparatus for applying the driving signals of FIG. 6. Referring to FIGS. 5 and 10, a 3-electrode plasma panel driving apparatus according to the present invention includes an image processor 66, a logic controller 62, an address driver 63, an X-driver 64, and a Y-driver 65.

The Y-driver 65 includes a reset/sustaining circuit RSC, a scan driving circuit AC, and a switching output circuit SIC. The reset/sustaining circuit RSC generates driving signals to be applied to the Y electrode lines $Y_1$ through $Y_n$ during the reset period PR and the display sustaining period PS. The scan driving circuit AC generates driving signals to be applied to the Y electrode lines $Y_1$ through $Y_n$ during the addressing period PA. In the switching output circuit SIC, upper transistors YU1 through and YUn and lower transistors YL1 through YLn are disposed such as to obtain upper transistor/lower transistor pairs, and the common output lines of the upper transistor/lower transistor pairs are connected to the Y electrode lines $Y_1$ through $Y_n$ of the 3-electrode plasma display panel 1.

Figure 9:
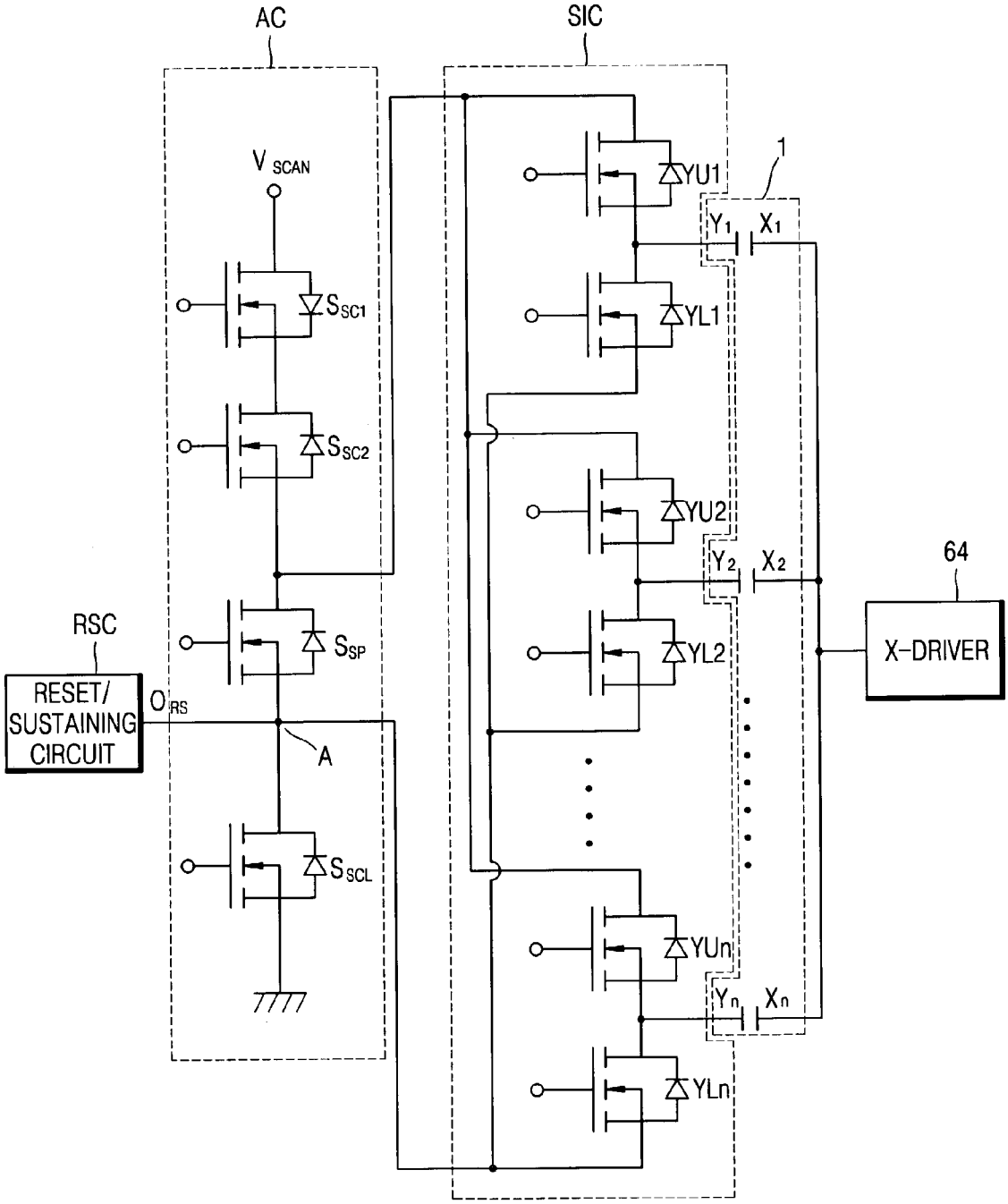
FIG. 9 (RELATED ART)
FIG. 9 is a circuit diagram showing a conventional scan driving circuit and a switching output circuit that are included in a Y driver of a driving apparatus for applying the driving signals of FIG. 6.

A capacitor $C_{SP}$ included in the scan driving circuit AC is connected between the common power line of all upper transistors YU1 through YUn in the SIC and the common power line of all lower transistors YL1 through YLn of the SIC. A voltage obtained by charging the capacitor $C_{SP}$ is applied to the common power line of the upper transistors YU1 through YUn of the SIC. Accordingly, the capacitor $C_{SP}$ can be charged with a constant voltage all the time, such that the two large power transistors $S_{SC1}$ and $S_{SC2}$ of FIG. 9 do not need to be provided between the common power line of the upper transistors YU1 through YUn of the switching output circuit SIC and a power terminal, that is, the port of a scan bias voltage $V_{SCAN}$. Also, the large power transistor $S_{SP}$ does not need to be connected to the capacitor $C_{SP}$. The reason for the above fact is as follows.

In the scan driving circuit AC, a diode $D_U$ to serve as a one-way current control device is connected to the common power line of all of the upper transistors YU1 through YUn of the switching output circuit SIC and the terminal of the scan bias voltage $V_{SCAN}$. Hence, the capacitor $C_{SP}$ is charged by the diode $D_U$, and the scan bias voltage $V_{SCAN}$ due to the charging is applied to the common power line of the upper transistors YU1 through YUn of the switching output circuit SIC. A large power transistor $S_{SCL}$ is connected between the common power line of the lower transistors YL1 through YLn of the switching output circuit SIC and a ground line. The operation of the Y-driver of FIG. 10 will now be described with reference to FIGS. 6 and 10.

During the reset period PR and the display sustaining period PS, excluding a scanning time (addressing period PA), the large power transistor $S_{SCL}$ is turned off, such that the driving signals $O_{RS}$ from the reset/sustaining circuit RSC are applied to the common power line of all of the lower transistors Y1 through YLn in the switching output circuit SIC. At this time, all of the lower transistors YL1 through YLn in the switching output circuit SIC are turned on, and all of the upper transistors YU1 through YUn are turned off. Accordingly, the driving signals $O_{RS}$ from the RSC are applied to the Y electrode lines $Y_1$ through $Y_n$ via the lower transistors YL1 through YLn in the switching output circuit SIC.

During the addressing period PA, that is, the scanning period, a scan bias voltage $V_{SCAN}$ due to charging of the capacitor $C_{SP}$ is applied to the common power line of the upper transistors YU1 through YUn of the switching output circuit SIC. Since the large power transistor $S_{SCL}$ is turned on, the ground voltage $V_G$ of FIG. 6 is applied via the large power transistor $S_{SCL}$ to the lower transistors YL1 through YLn of the switching output circuit SIC. In this case, the lower transistor connected to a Y electrode line to be scanned is turned on, while the upper transistor connected to the Y electrode line to be scanned is turned off. The lower transistors connected to the other Y electrode lines not to be scanned are turned off, while the upper transistors connected to the Y electrode lines not to be scanned are turned on. Hence, the scan ground voltage $V_G$ is applied to the one Y electrode line to be scanned, and the scan bias voltage $V_{SCAN}$ is applied to the other Y electrode lines not to be scanned.

During the addressing period PA, the current paths at the point in time when the scan ground voltage $V_G$ is applied to the one Y electrode line to be scanned, when a display data signal is applied to the address electrode lines $A_{R1}$, $A_{G1}$ through $A_{Gm}$, and $A_{Bm}$, when the application of the display data signal to the address electrode lines is terminated, and when the application of the scan ground voltage $V_{SCAN}$ to the one Y electrode line to be scanned is terminated, will now be described.

Firstly, at the point in time when the scan ground voltage $V_G$ is applied to the one Y electrode line to be scanned, current from the display cells (electrical capacitors) connected to the one Y electrode line to be scanned passes through a lower transistor in the switching output circuit SIC and the large power transistor $S_{SCL}$ in the scan driving circuit AC and then flows to a ground terminal.

Secondly, at the point in time when a display data signal is applied to the address electrode lines $A_{R1}$, $A_{G1}$ through $A_{Gm}$, and $A_{Bm}$, discharge current from the address electrode lines to which a selection voltage $V_A$ has been applied flows to an Y electrode line that is being scanned. At this time, current sequentially passes through the other Y electrode lines not scanned, the upper transistors of the switching output circuit SIC, the capacitor $C_{SP}$ in the scan driving circuit AC, and the large power transistor $S_{SCL}$ in the scan driving circuit AC and then flows to the ground terminal.

Thirdly, at the point in time when the application of the display data signal to the address electrode lines terminates, current from the capacitor $C_{SP}$ of the scan driving circuit AC passes through the upper transistors of the switching output circuit SIC and the Y electrode lines and then flows to the address electrodes $A_{R1}$, $A_{G1}$ through $A_{Gm}$, and $A_{Bm}$.

Fourthly, at the point in time when the application of the scan ground voltage $V_G$ to the one Y electrode line to be scanned terminates, current from the capacitor $C_{SP}$ of the scan driving circuit AC passes through the upper transistors of the switching output circuit SIC and the Y electrode lines and then flows to the display cells (electrical capacitors).

During the reset period PR, the addressing period PA, and the display sustaining period PS, a constant voltage flows in the capacitor $C_{SP}$. This prevents unstable driving and does not increase power consumption (refer to the description of the prior art). As a result, the scan driving circuit AC according to the present invention can save 3 costly large power transistors compared to a conventional scan driving circuit (e.g., the scan driving circuit AC of FIG. 9).

Figure 11:
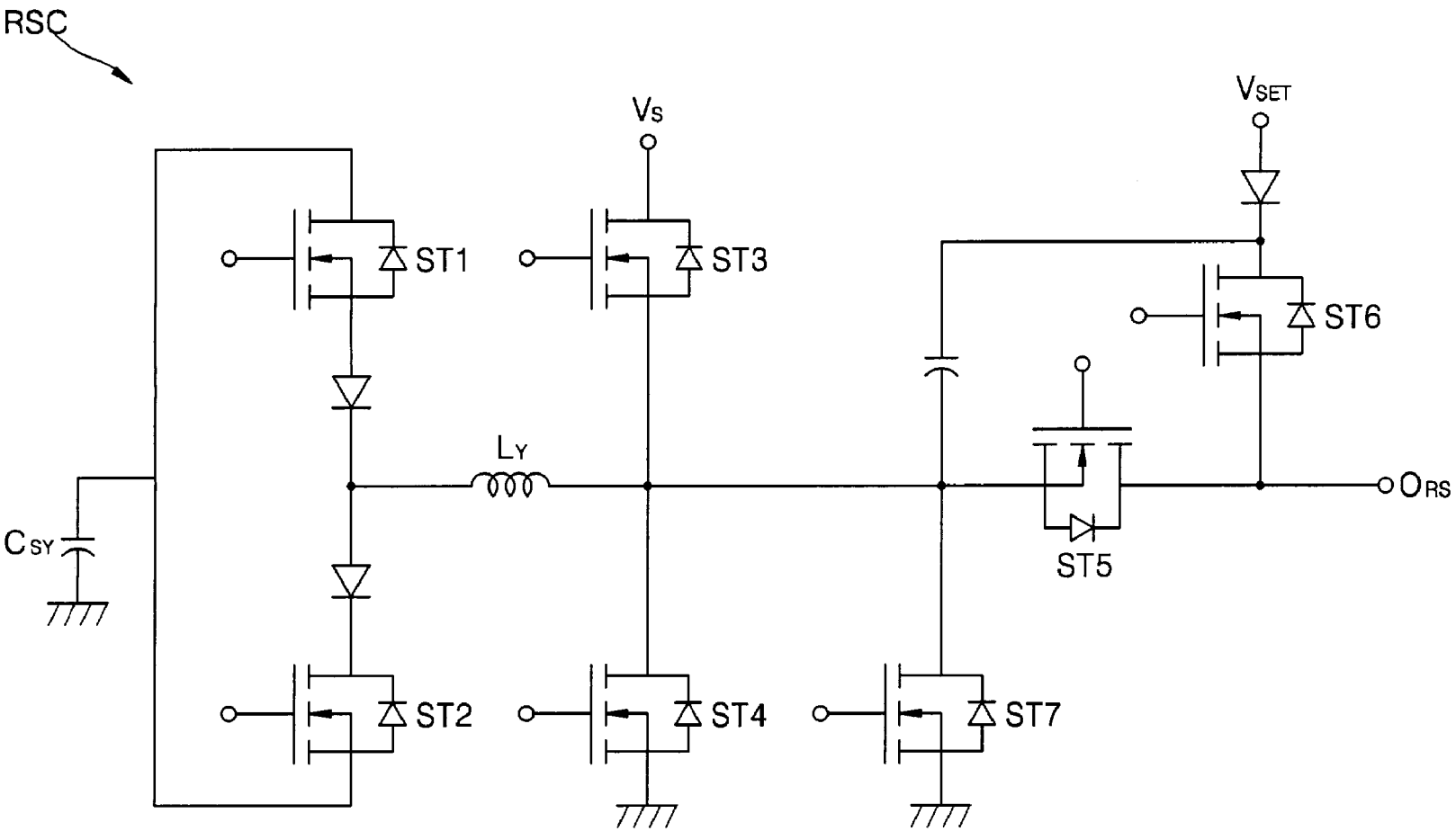
FIG. 11 is a circuit diagram of the reset/sustaining circuit of FIG. 10.

FIG. 11 shows the reset/sustaining circuit RSC of FIG. 10. Referring to FIG. 11, first through sixth transistors ST3 through ST6 generate a driving signal $O_{RS}$ to be applied to the Y electrode lines during the reset period PR. A power reproduction capacitor $C_{SY}$, first through fifth transistors ST1 through S5, and a tuning coil $L_Y$ generate the driving signal $O_{RS}$ to be applied to the Y electrode lines during the display sustaining period PS. The operation of the reset/sustaining circuit RSC of FIG. 11 will now be described with reference to FIGS. 6 and 11.

During the reset period PR of a unit subfield SF, only the fourth and fifth transistors ST4 and ST5 are turned on while a voltage applied to X electrode lines $X_1$ through $X_n$ continuously increases from the ground voltage $V_G$ to a second voltage $V_S$, for example, 155V. Accordingly, the ground voltage $V_G$ is applied to the all of the Y electrode lines $Y_1$ through $Y_n$.

Next, only the third transistor ST3 and the sixth transistor ST6 are turned on, and a third voltage $V_{SET}$ is applied to the drain of the sixth transistor ST6. At this time, a continuously rising control voltage is applied to the gate of the sixth transistor ST6, such that the channel resistance value of the sixth transistor ST6 continuously decreases. Also, since the second voltage $V_S$ is applied to the source of the third transistor ST3, a voltage that rises from the second voltage $V_S$ and a maximum voltage ($V_{SET}$+$V_S$) is applied to the drain of the sixth transistor ST6 by the action of the capacitor connected between the source of the third transistor ST3 and the drain of the sixth transistor ST6. Accordingly, the voltage that rises from the second voltage $V_S$ and the maximum voltage ($V_{SET}$+$V_S$), for example, 355V, is applied to all of the Y electrode lines $Y_1$ through $Y_n$.

Thereafter, only the third and fifth transistors ST3 and ST5 are turned on, such that the second voltage $V_S$ is applied to all of the Y electrode lines $Y_1$ through $Y_n$.

Next, only the fifth and seventh transistors ST5 and ST7 are turned on, and a continuously rising control voltage is applied to the gate of the seventh transistor ST7 such that the channel resistance value of the seventh transistor ST7 continuously decreases. Accordingly, the voltage applied to all of the Y electrode lines $Y_1$ through $Y_n$ continuously falls from the second voltage $V_S$ to the ground voltage $V_G$.

During the following addressing period PA, all of the transistors ST3 through ST6 of the RSC are turned off, such that the output of the RSC enters into an electrical floating state.

During the following display sustaining period PS, while a unit pulse applied to all of the Y electrode lines $Y_1$ through $Y_n$ falls from the second voltage $V_S$ to the ground voltage $V_G$, only the second and fifth transistors ST2 and ST5 are turned on. Hence, charges unnecessarily remaining in the display cells (electrical capacitors) are collected in the power reproduction capacitor $C_{SY}$. The collected charges are applied to all of the Y electrode lines $Y_1$ through $Y_n$ while the unit pulse rises from the ground voltage $V_G$ to the second voltage $V_S$, so that they are re-cycled.

If the above fact is described step by step, first, only the second and fifth transistors ST2 and ST5 are turned on while a unit pulse applied to all of the Y electrode lines $Y_1$ through $Y_n$ rises from the ground voltage $V_G$ to the second voltage $V_S$. Hence, charges collected in the power reproduction capacitor $C_{SY}$ are applied to all of the Y electrode lines $Y_1$ through $Y_n$.

Next, only the third and fifth transistors ST3 and ST5 are turned on, such that the second voltage $V_S$ is applied to all of the Y electrode lines $Y_1$ through $Y_n$.

Thereafter, only the second and fifth transistors ST2 and ST5 are turned on while a voltage falls from the second voltage $V_S$ to the ground voltage $V_G$. Hence, charges unnecessarily remaining in the display cells (electrical capacitors) are collected in the power reproduction capacitor $C_{SY}$.

In the end, only the fourth and fifth transistors ST4 and ST5 are turned on, such that the ground voltage $V_G$ is applied to all of the Y electrode lines $Y_1$ through $Y_n$.

Figure 12:
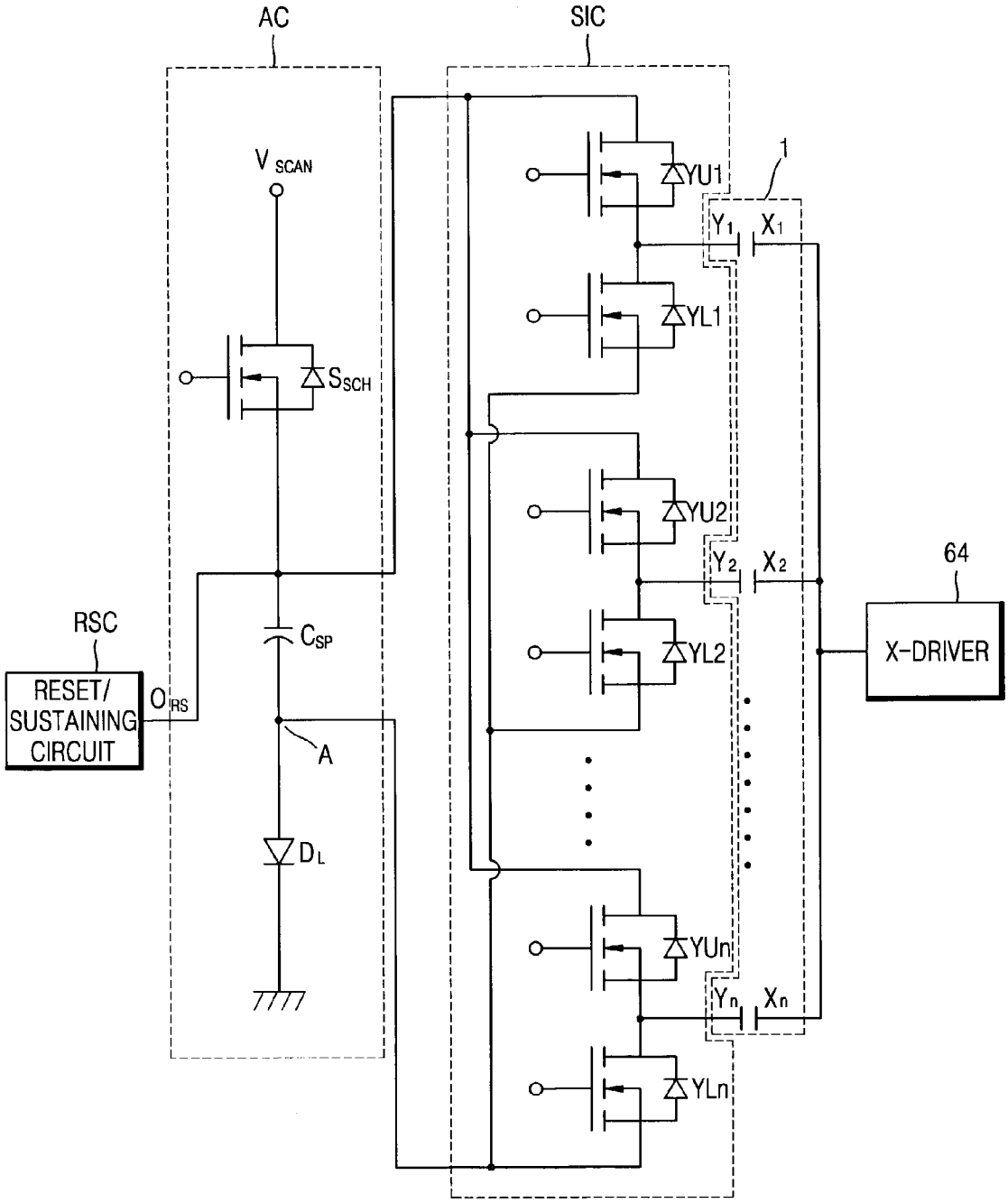
FIG. 12 is a circuit diagram showing a scan driving circuit according to another embodiment of the present invention and a switching output circuit that are included in the Y driver of a driving apparatus for applying the driving signals of FIG. 6.

FIG. 12 is a circuit diagram showing a scan driving circuit AC according to another embodiment of the present invention and a switching output circuit SIC that are included in the Y driver 65 of FIG. 5 in the driving apparatus for applying the driving signals of FIG. 6.

A capacitor $C_{SP}$ included in the scan driving circuit AC is connected between the common power line of all upper transistors YU1 through YUn in the switching output circuit SIC and the common power line of all lower transistors YL1 through YLn of the switching output circuit SIC. A voltage obtained by charging the capacitor $C_{SP}$ is applied to the common power line of the upper transistors YU1 through YUn of the switching output circuit SIC. Accordingly, the capacitor $C_{SP}$ can be charged with a constant voltage all the time, so that the two large power transistors $S_{SC1}$ and $S_{SC2}$ of FIG. 9 do not need to be provided between the common power line of the upper transistors YU1 through YUn of the switching output circuit SIC and a power terminal, that is, the port of a scan bias voltage $V_{SCAN}$. Also, the large power transistor $S_{SP}$ does not need to be connected to the capacitor $C_{SP}$. The reason for the above fact is as follows.

In the scan driving circuit AC, a large power transistor $S_{SCH}$ is connected to the common power line of all the upper transistors YU1 through YUn of the switching output circuit SIC and the terminal of the scan bias voltage $V_{SCAN}$. The capacitor $C_{SP}$ is charged through the large power transistor $S_{SCH}$, and the scan bias voltage $V_{SCAN}$, due to the charging, is applied to the common power line of the upper transistors YU1 through YUn of the switching output circuit SIC. A diode $D_L$ serving as a one-way current control device is applied to the common power line of the lower transistors YL1 through YLn of the switching output circuit SIC and a ground line. The operation of the Y-driver of FIG. 12 will now be described with reference to FIGS. 6 and 12.

During the reset period PR and the display sustaining period PS, excluding a scanning time (addressing period PA), the large power transistor $S_{SCH}$ is turned off. The driving signals $O_{RS}$ from the reset/sustaining circuit RSC are applied to the common power line of all the upper transistors YU1 through YUn in the switching output circuit SIC. At this time, all of the upper transistors YU1 through YUn in the switching output circuit SIC are turned on, and all of the lower transistors YL1 through YLn are turned off. Accordingly, the driving signals $O_{RS}$ from the reset/sustaining circuit RSC are applied to the Y electrode lines $Y_1$ through $Y_n$ via the upper transistors YU1 through YUn in the switching output circuit SIC.

During the addressing period PA, that is, the scanning period, a scan bias voltage $V_{SCAN}$ due to charging of the capacitor $C_{SP}$ is applied to the common power line of the upper transistors YU1 through YUn of the SIC. The ground voltage $V_G$ of FIG. 6 is also applied via the diode $D_L$ to the lower transistors YL1 through YLn of the switching output circuit SIC. In this case, the lower transistor connected to a Y electrode line to be scanned is turned on, while the upper transistor connected to the Y electrode line to be scanned is turned off. The lower transistors connected to the other Y electrode lines not to be scanned are turned off, while the upper transistors connected to the Y electrode lines not to be scanned are turned on. Hence, the scan ground voltage $V_G$ is applied to the one Y electrode line to be scanned, and the scan bias voltage $V_{SCAN}$ is applied to the other Y electrode lines not to be scanned.

During the addressing period PA, the current paths at the point in time when the scan ground voltage $V_G$ is applied to the one Y electrode line to be scanned, when a display data signal is applied to the address electrode lines $A_{R1}$, $A_{G1}$ through $A_{Gm}$, and $A_{Bm}$, when the application of the display data signal to the address electrode lines $A_{R1}$, $A_{G1}$ through $A_{Gm}$, and $A_{Bm}$ is terminated, and when the application of the scan ground voltage $V_{SCAN}$ to the one Y electrode line to be scanned terminates, will now be described.

Firstly, when the scan ground voltage $V_G$ is applied to the one Y electrode line to be scanned, current from the display cells (electrical capacitors) connected to the one Y electrode line to be scanned passes through a lower transistor in the switching output circuit SIC and the diode $D_L$ in the scan driving circuit AC and then flows to a ground terminal.

Secondly, when a display data signal is applied to the address electrode lines $A_{R1}$, $A_{G1}$ through $A_{Gm}$, and $A_{Bm}$, discharge current from the address electrode lines to which a selection voltage $V_A$ has been applied flows to a Y electrode line that is being scanned. At this time, current sequentially passes through the other Y electrode lines not scanned, the upper transistors of the switching output circuit SIC, the capacitor $C_{SP}$ in the scan driving circuit AC, and the diode $D_L$ in the scan driving circuit AC and then flows to the ground terminal.

Thirdly, when the application of the display data signal to the address electrode lines $A_{R1}$, $A_{G1}$ through $A_{Gm}$, and $A_{Bm}$ terminates, current from the capacitor $C_{SP}$ of the AC passes through the upper transistors of the SIC and the Y electrode lines and then flows to the address electrodes $A_{R1}$, $A_{G1}$ through $A_{Gm}$, and $A_{Bm}$.

Fourthly, when the application of the scan ground voltage $V_G$ to the one Y electrode line to be scanned terminates, current from the capacitor $C_{SP}$ of the scan driving circuit AC passes through the upper transistors of the SIC and the Y electrode lines and then flows to the display cells (electrical capacitors).

During the reset period PR, the addressing period PA, and the display sustaining period PS, a constant voltage flows in the capacitor $C_{SP}$. As a result, driving is prevented from becoming unstable, and an increase in power consumption is counteracted. As a result, the scan driving circuit AC according to the present invention can save the cost of three large power transistors compared to a conventional scan driving circuit (e.g., the scan driving circuit AC of FIG. 9).

As described above, in a 3-electrode plasma display panel driving apparatus according to the present invention, since a constant voltage is maintained in the capacitor CSP of the scan driving circuit AC of the Y-driver, two large power transistors as required in a conventional scan driving circuit AC do not need to be connected between the common power line of the upper transistors YU1 through YUn of the SIC and the power terminal of the scan bias voltage $V_{SCAN}$. Further, not even one large power transistor needs to be connected to the capacitor $C_{SP}$.

While the present invention has been particularly shown and described with reference to preferred embodiments thereof, it will be understood by those of ordinary skill in the art that various changes in form and details may be made therein without departing from the spirit and scope of the present invention as defined by the appended claims.

What is claimed is:

1. A plasma display panel driving apparatus, comprising:

a switching output circuit having upper transistors and lower transistors disposed in such a way that the common output line of an upper transistor and a lower transistor is connected to a corresponding Y electrode line;

a capacitor connected directly between the common power line of all of the upper transistors in the switching output circuit and the common power line of all of the lower transistors in the switching output circuit;

a reset/sustaining circuit coupled with Y-electrode lines, the reset/sustaining circuit to apply a reset waveform to the Y-electrode lines during a reset period and apply a sustain voltage signal to the Y-electrode lines during a sustain period; and a voltage terminal supplying a scan bias voltage to the capacitor, wherein a magnitude of the scan bias voltage is less than a magnitude of the sustain voltage signal.

2. The plasma display panel driving apparatus of claim 1, further comprising:

a one-way current control device connected between the common power line of all of the upper transistors of the switching output circuit and the voltage terminal of the scan bias voltage.

3. The plasma display panel driving apparatus of claim 2, wherein the capacitor is charged through the one-way current control device.

4. The plasma display panel driving apparatus of claim 1, wherein the scan bias voltage due to the charging is applied to the common power line of the upper transistors of the switching output circuit.

5. The plasma display panel driving apparatus of claim 2, wherein the one-way current control device is a diode.

6. The plasma display panel driving apparatus of claim 2, wherein a switching transistor is connected between the common power line of all of the lower transistors of the switching output circuit and a ground line, and remains off during a reset period and a sustain period, such that driving signals from the reset/sustaining circuit are applied to the common power line of all of the lower transistors of the switching output circuit.

7. The plasma display panel driving apparatus of claim 1, wherein a switching transistor is connected between the common power line of all of the upper transistors of the switching output circuit and the terminal of the scan bias voltage, the capacitor is charged while the switching transistor is turned on, the scan bias voltage due to the charging is applied to the common power line of all of the upper transistors of the switching output circuit.

8. The plasma display panel driving apparatus of claim 7, wherein the switching transistor remains off during a reset period and a sustain period, such that driving signals from the reset/sustaining circuit are applied to the common power line of all of the upper transistors of the switching output circuit.

9. The plasma display panel driving apparatus of claim 7, wherein a one-way current control device is connected between the common power line of all of the lower transistors of the switching output circuit and a ground line.

10. A plasma display panel driving apparatus, comprising:

a controller for generating driving control signals according to an internal image signal;

an address driver for processing an address signal from the controller to obtain a display data signal and applying the display data signal to address electrode lines;

a Y-driver for processing a Y driving control signal from the controller and applying the processed Y driving control signal to Y electrode lines, wherein the Y-driver comprises:

a switching output circuit having upper transistors and lower transistors disposed so that the common output line of an upper transistor and a lower transistor is connected to a corresponding Y electrode line;

a capacitor connected directly between the common power line of all of the upper transistors in the switching output circuit and the common power line of all of the lower transistors in the switching output circuit;

a reset/sustaining circuit coupled with the Y-electrode lines, the reset/sustaining circuit to apply a reset waveform to the Y-electrode lines during a reset period and apply a sustain voltage signal to the Y-electrode lines during a sustain period; and a voltage terminal supplying a scan bias voltage to the capacitor, wherein a magnitude of the scan bias voltage is less than a magnitude of the sustain voltage signal.

11. The plasma display panel driving apparatus of claim 10, further comprising:

an X-driver for processing an X driving control signal from the controller and applying the processed X driving control signal to X electrode lines; and an image processor for converting an external analog image signal into a digital signal to obtain the internal image signal.

12. The plasma display panel driving apparatus of claim 10, wherein the Y-driver further comprises a one-way current control device connected between the common power line of all the lower transistors of the switching output circuit and a ground line.

13. The plasma display panel driving apparatus of claim 10, wherein the Y-driver further comprises a switching transistor connected between the scan bias voltage terminal and the capacitor, the capacitor is charged while the switching transistor is turned on, the scan bias voltage due to the charging applied to the common power line of all the upper transistors of the switching output circuit.

14. The plasma display panel driving apparatus of claim 13, wherein the reset/sustaining circuit is connected to all of the upper transistors in the switching output circuit and is connected to a contact between the switching transistor and the capacitor.

15. The plasma display panel driving apparatus of claim 14, wherein the switching transistor remains off during a reset period and a sustain period when driving signals from the reset/sustaining circuit are applied to the common power line of all the upper transistors of the switch output circuit.

16. The plasma display panel driving apparatus of claim 10, wherein the Y-driver further comprises a one-way current control device connected between the common power line of all of the upper transistors of the switching output circuit and the voltage terminal of a scan bias voltage, the capacitor is charged through the one-way current control device, the scan bias voltage due to the charging is applied to the common power line of the upper transistors of the switching output circuit.

17. The plasma display panel driving apparatus of claim 10, wherein the Y-driver further comprises a switching transistor connected between the common power line of all of the lower transistors of the switching output circuit and a ground line.

18. The plasma display panel driving apparatus of claim 17, wherein the reset/sustaining circuit is connected to all of the lower transistors in the switching output circuit and is connected to a contact between the switching transistor and the capacitor.

19. The plasma display panel driving apparatus of claim 18, wherein the switching transistor remains off during a reset period and a sustain period when driving signals from the reset/sustaining circuit are applied to the common power line of all the lower transistors of the switch output circuit.

* * * * *